US012495919B2

(12) United States Patent
Manuszak et al.

(10) Patent No.: US 12,495,919 B2
(45) Date of Patent: Dec. 16, 2025

(54) MOLDED HYBRID PILLOW

(71) Applicant: SEALY TECHNOLOGY, LLC, Trinity, NC (US)

(72) Inventors: Brian M. Manuszak, Thomasville, NC (US); Robbie Hanson, Greensboro, NC (US); James A. Beamon, Jamestown, NC (US); Allen M. Platek, Jamestown, NC (US)

(73) Assignee: SEALY TECHNOLOGY LLC, Trinity, NC (US)

( * ) Notice: Subject to any disclaimer, the term of this patent is extended or adjusted under 35 U.S.C. 154(b) by 432 days.

(21) Appl. No.: 17/849,012

(22) Filed: Jun. 24, 2022

(65) Prior Publication Data

US 2022/0408945 A1 Dec. 29, 2022

Related U.S. Application Data

(60) Provisional application No. 63/214,503, filed on Jun. 24, 2021.

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ..... A47C 20/00; A47C 21/02; A47C 27/064; A47C 27/085; A47C 27/20; A47G 9/10; A47G 2009/1018
See application file for complete search history.

(56) References Cited

U.S. PATENT DOCUMENTS

| | | | |
|---|---|---|---|
| 3,148,389 | A | 9/1964 | Lustig |
| 3,173,159 | A | 3/1965 | Hart |
| 3,204,016 | A | 8/1965 | Sanger et al. |

(Continued)

FOREIGN PATENT DOCUMENTS

| | | | |
|---|---|---|---|
| CN | 204797302 | U | 11/2015 |
| GB | 2514249 | A | 11/2014 |
| TW | M595458 | U | 5/2020 |

OTHER PUBLICATIONS

United States Patent and Trademark Office, International Search Report and Written Opinion issued in corresponding Application No. PCT/US2022/034916 mailed Sep. 15, 2022.

(Continued)

*Primary Examiner* — Fredrick C Conley
(74) *Attorney, Agent, or Firm* — Stites & Harbison, PLLC; Terry L. Wright; James R. Hayne

(57) ABSTRACT

A hybrid pillow includes a cushion material defining a recess. A coil panel is positioned within the recess of the cushion material with the coil panel formed of a plurality of coil springs, an upper fabric layer, and a lower fabric layer. The upper fabric layer and the lower fabric layer are joined between the plurality of coil springs and along peripheral edges of the first coil panel. A gel layer is also positioned within the recess of the cushion material and over the coil panel. A method of manufacturing the pillow includes dispensing a liquid gel in a mold, positioning a coil panel in the mold and on top of the liquid gel, dispensing a foam precursor in the mold, and foaming the foam precursor to form a cushion material that is secured to the coil panel.

19 Claims, 9 Drawing Sheets

(56) References Cited

U.S. PATENT DOCUMENTS

| | | | | |
|---|---|---|---|---|
| 6,745,420 | B2 | 6/2004 | Giori et al. | |
| 7,051,389 | B2 | 5/2006 | Wassilefky | |
| 7,350,251 | B2 * | 4/2008 | Fraser | B62J 1/26 5/653 |
| 7,415,742 | B2 | 8/2008 | Wassilefsky | |
| 7,530,127 | B2 | 5/2009 | Leifermann et al. | |
| 7,735,169 | B2 | 6/2010 | Wassilefsky | |
| 8,656,537 | B2 | 2/2014 | Leifermann et al. | |
| 9,635,952 | B1 | 5/2017 | Anthony et al. | |
| 9,955,804 | B2 | 5/2018 | Fulkerson et al. | |
| 10,314,418 | B1 | 6/2019 | Bruno | |
| 10,357,113 | B2 | 7/2019 | Gladney | |
| D870,297 | S | 12/2019 | Chase et al. | |
| 10,694,874 | B2 | 6/2020 | Fulkerson et al. | |
| 10,993,543 | B2 | 5/2021 | Pennington | |
| 11,026,517 | B2 | 6/2021 | DeMoss et al. | |
| 11,559,151 | B2 | 1/2023 | Russell et al. | |
| 2004/0226098 | A1 * | 11/2004 | Pearce | B29C 44/50 264/141 |
| 2005/0102756 | A1 * | 5/2005 | Martin | A47G 9/10 5/636 |
| 2007/0246157 | A1 | 10/2007 | Mason et al. | |
| 2009/0043595 | A1 * | 2/2009 | Rawls-Meehan | G06Q 10/20 705/300 |
| 2011/0289689 | A1 | 12/2011 | Mikkelsen et al. | |
| 2013/0055503 | A1 * | 3/2013 | Huang | A47C 7/746 5/652.1 |
| 2013/0263377 | A1 * | 10/2013 | Wootten, Jr. | A47C 27/15 5/640 |
| 2015/0272354 | A1 | 10/2015 | Asklof et al. | |
| 2016/0166074 | A1 | 6/2016 | Rose et al. | |
| 2016/0316927 | A1 * | 11/2016 | Thomas | A47C 27/064 |
| 2016/0316929 | A1 | 11/2016 | Danielson | |
| 2017/0245664 | A1 | 8/2017 | Ives | |
| 2018/0078046 | A1 | 3/2018 | Tuton | |
| 2019/0038043 | A1 * | 2/2019 | Fisher | A47C 27/20 |
| 2019/0150630 | A1 * | 5/2019 | Codos | A47C 27/053 |
| 2019/0216241 | A1 * | 7/2019 | Codos | A47G 9/10 |
| 2019/0290033 | A1 | 9/2019 | Lonstein | |
| 2019/0316927 | A1 | 10/2019 | Pu et al. | |
| 2019/0387896 | A1 | 12/2019 | Lisenbee et al. | |
| 2020/0187687 | A1 | 6/2020 | Helms et al. | |
| 2020/0390247 | A1 | 12/2020 | Taylor et al. | |
| 2022/0408935 | A1 | 12/2022 | Manuszak et al. | |
| 2022/0408946 | A1 | 12/2022 | Manuszak et al. | |

OTHER PUBLICATIONS

United States Patent and Trademark Office, International Search Report and Written Opinion issued in corresponding Application No. PCT/US2022/034910 mailed Sep. 22, 2022.

Textile World, Nanobionic: A New Sleep Technology Designed for High Performance Rest and Recovery. Nov. 9, 2020 [retrieved on Aug. 26, 2022]. Retrieved from the internet. < URL:https://www.textile-world/2020/11/introducing-sleepcharge-a-new-innovation-in-sleep-technology-designed-for-high-performance-rest-and-recovery/ >.

United States Patent and Trademark Office, International Search Report and Written Opinion issued in corresponding Application No. PCT/US2022/034928 mailed Sep. 15, 2022.

European Patent Office; Extended European Search Report; Apr. 4, 2025, 27 pages.

* cited by examiner

MOLDED HYBRID PILLOW

RELATED APPLICATIONS

This application claims priority from U.S. Provisional Application Ser. No. 63/214,503, filed Jun. 24, 2021, the entire disclosure of which is incorporated herein by this reference.

TECHNICAL FIELD

The present invention relates to a hybrid pillow. In particular, the present invention relates to a molded hybrid pillow that includes coil panels and a gel layer embedded within a foam comfort layer.

BACKGROUND

The effectiveness and desirability of a support cushion is partly a function of how comfortable a user is on the support cushion over an extended period of time. In this regard, many users find support cushions, and in particular mattresses, which are made of a flexible foam to be desirable. Over the lifetime of body support cushions, such as mattresses and pillows, however, flexible foams can lose height and firmness. The durability loss of the support cushion can then result in a decline in the comfort of the body support cushion.

Of course, it is desirable that the resilience and comfort of a body support cushion be maintained for as long as possible, and there is a continuous desire to improve the durability, comfort, and resilience of these products. Accordingly, body support cushions that allow for such an improvement in the durability, comfort, and resilience, and which allow such features to be maintained over an extended period of time would be both highly desirable and beneficial.

SUMMARY

The present invention includes a hybrid body support cushion, such as a hybrid pillow. In some embodiments, the hybrid pillow comprises various layers including one or more coil panels which are integrally formed into a foam cushion structure along with a gel layer encapsulating the coil panel between the gel and foam.

In some embodiments of the present invention, an exemplary body support cushion in the form of a pillow includes a cushion material which defines a recess. A coil panel and a gel layer, which collectively form a gel molded spring array are positioned within the recess.

In some embodiments, the recess defined in the upper surface of the cushion material is generally rectangular, but it is contemplated that the recess may be formed of various perimeter shapes and have various depths according to the shape and size of the coil panel and the gel layer (i.e., the gel molded spring array).

In some embodiments, the coil panel is formed of a plurality of coil springs which are laid out in an array or matrix of rows and/or columns. An upper first fabric layer is arranged over an upper end of each coil spring and a lower second fabric layer arranged under the lower end of each coil spring. The first and second fabric layers are joined, e.g. welded, between the coil springs, thereby forming a coil pocket. The ends of the coil springs may be in direct contact with the fabric layers, or alternatively, a piece of material, such as cushion or scrim may be disposed between the coil springs and the fabric layers. Such intermediate material may inhibit the coil springs from poking through or otherwise tearing the fabric layers.

In some embodiments, the fabric layers are capable of minimizing, or entirely preventing, the gel layer from infiltrating, creeping, or otherwise coming into contact with the coil springs. To this end, in some embodiments, the first and second fabric layers are a hydrophobic fabric, water-resistant fabric, or the like.

In some embodiments, the gel layer is a substantially uniform layer of elastomeric gelatinous material that is capable of providing a cooling effect by acting as a thermal dump or heat sink into which heat from a user's body, or portion thereof positioned on the pillow can dissipate.

In some embodiments, the gel layer may have an outer surface which is substantially smooth, but the surface shape and texture of the gel may be determined by the corresponding surface of the mold in which the gel is poured. Further, the gel may also vary in concentration along the surface of the pillow. The peripheral edge or perimeter of the gel may be regular or irregular in shape and the gel layer may vary in thickness and/or concentration. For example, the thickness of the gel may be greater in the center as compared to areas toward the periphery of the gel.

In some embodiments, the pillow includes two or more coil panels and/or two or more gel molded spring arrays. For example, there may be multiple gel molded spring arrays located across the upper surface of the cushion material or the pillow may include a first gel molded spring array on the upper surface and a second gel molded spring array on the lower surface.

According to some exemplary implementations of the present invention, a mold is provided and a liquid gel is dispensed in the mold. After the liquid gel is dispensed in the mold, a coil panel is positioned in the mold on top of the gel. After positioning the coil panel and gel to the mold, a liquid foam precursor is dispensed in the mold and the liquid precursor is foamed to form the cushion material.

According to some other implementations, rather than forming the gel layer in the same mold as the cushion material, the gel layer may be applied to the cushion material after the gel layer has been formed separately. The coil panel may still be provided in the mold prior to proving the foam precursor so that the coil panel is integrated into the cushion material. Alternatively, both the coil panel and the gel layer may be applied to the cushion material after it has been formed.

Further features and advantages of the present invention will become evident to those of ordinary skill in the art after a study of the description, figures, and non-limiting examples in this document.

DESCRIPTION OF EXEMPLARY EMBODIMENTS

The present invention includes a hybrid body support cushion, such as a hybrid pillow. In some embodiments, the hybrid pillow comprises various layers including one or more coil panels which are integrally formed into a foam cushion structure along with a gel layer encapsulating the coil panel between the gel and foam. The use of one or more coil panels allows for tuning by way of adjustment of various characteristics to a user's desire. For a non-limiting example, some users may want a thin pillow and others may want a thicker pillow. Still further, some users may prefer a firmer feel while others may prefer a softer feel.

Figure 1:
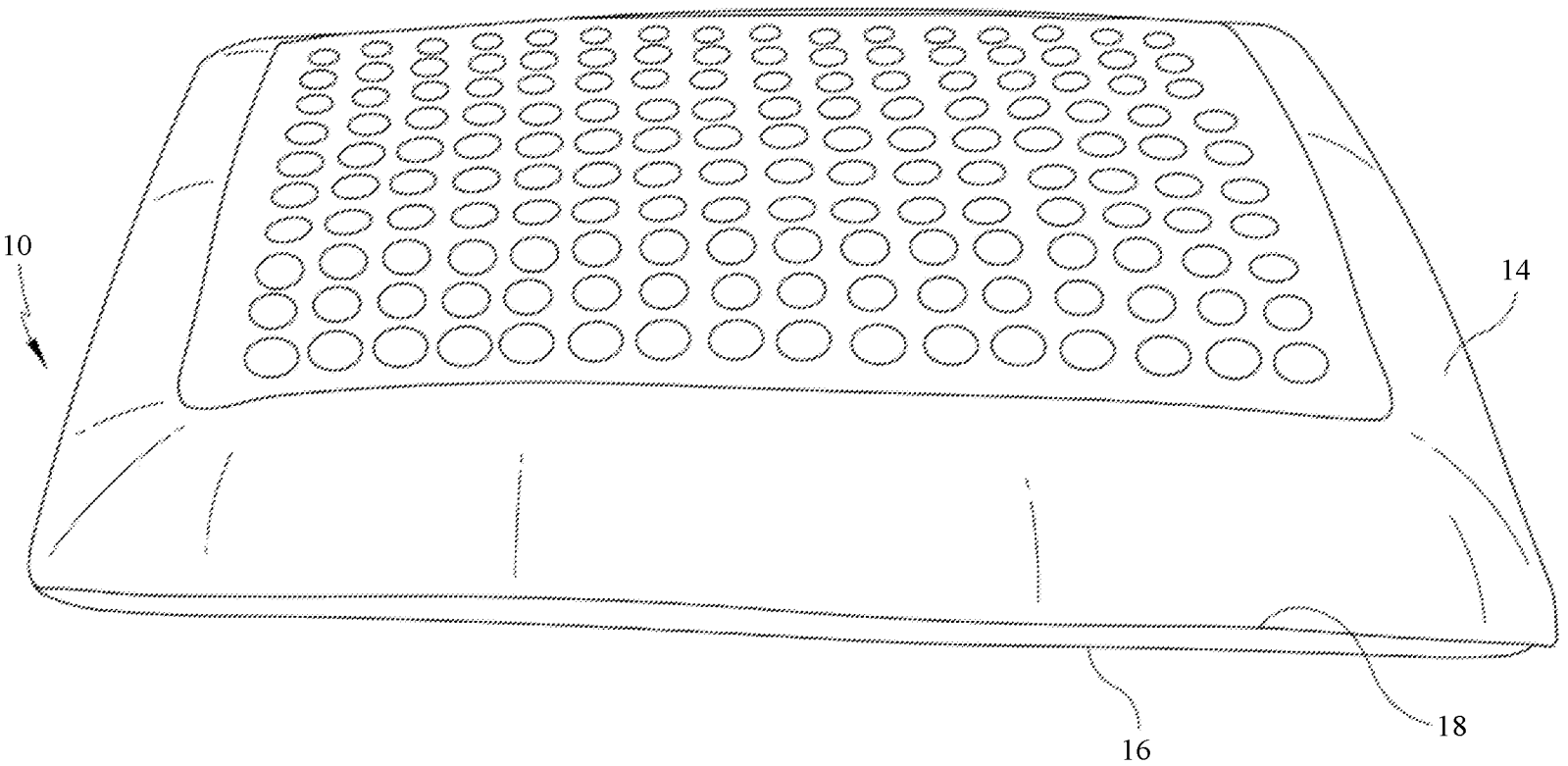
FIG. 1 is a perspective view of an exemplary hybrid pillow made in accordance with the present invention.

Referring first to FIG. 1, a perspective view of an exemplary body support cushion 10 is provided and for purpose of the instant teaching, and ease of reference, the body support cushion 10 is also referred to as a pillow, or hybrid pillow. However, a body support cushion made in accordance with the present invention may be embodied in various structures which support one or more portions of an end user's body. The term body support cushion may include, as a non-limiting example, various types of supports including bedding and/or cushions for chairs and furniture, pillows, padding for medical devices and equipment (e.g., wheelchair seat pads, wheelchair padding, medical pads, hospital gurney pads, operating table pads, positioning pads), padding for furniture (e.g., upholstery padding, furniture cushions, furniture pads), padding for athletic equipment and devices (e.g., athletic cushions, sports and athletic padding, gymnastic mats), padding for recreational equipment and devices (e.g., camping and sleeping mats), padding for apparel (e.g., bra straps, shoulder pads, shoe linings, boot linings), padding for household goods (e.g., anti-fatigue mats, mattress pads, mattress covers, mattress "toppers," the pillow-top portion of pillow-top mattresses, pillows, and the like); padding accessories (e.g., briefcase shoulder straps, computer carrying cases, purses, gloves, and the like), pet beds, and the like. Thus any of these types of structures, and others, may fall within the scope of the term pillow or body support cushion, which are used interchangeably.

Referring still to FIG. 1, the exemplary hybrid pillow 10 has a generally rectangular peripheral shape with an arcuate upper surface 14 and actuate lower surface 16 that are joined by arcuate curves at or around the peripheral edges 18 of the pillow 10. In the exemplary pillow, the height, or the distance between the upper surface 14 and the lower surface 16, of the pillow 10 is between about two and ten inches. In some other embodiments, the height is between about three and five inches. However, it is to be understood that this range is not exhaustive and other sizes may also be utilized.

Exemplary pillows may be arcuate in one or both longitudinal (long) and latitudinal (short) dimensions. Likewise, exemplary pillows may have a generally flat upper and/or lower surface which are joined by straight or arcuate curves at or around a peripheral edge of the pillow, or alternatively the upper and/or lower surfaces may be entirely arcuate. As used herein, a "peripheral edge" may be one or more edges which define the shape of the pillow. Exemplary pillows may also have various shapes other than the rectangular shape shown and therefore, the shape should not be considered limiting.

Figure 2:
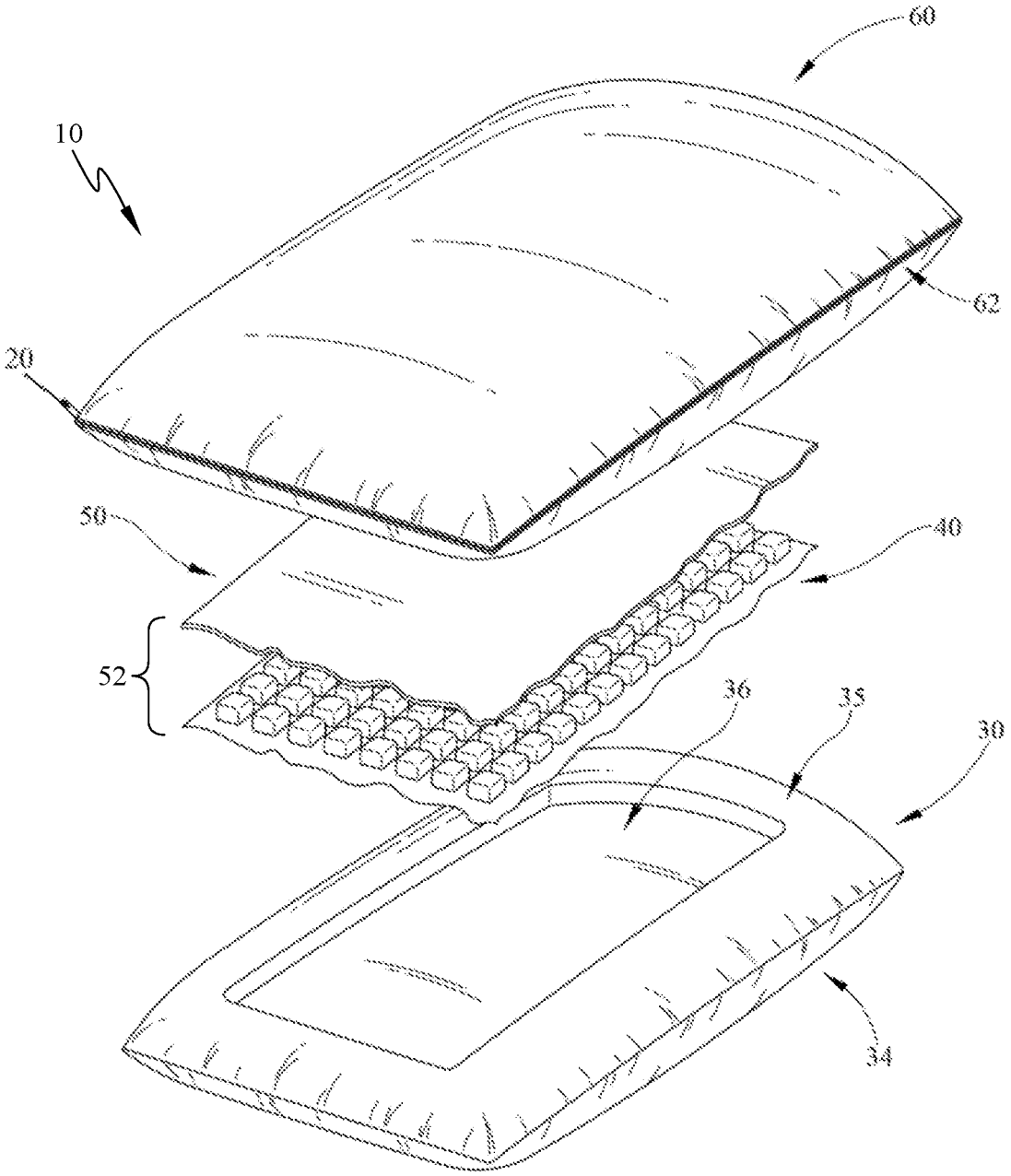
FIG. 2 is an exploded perspective view of the hybrid pillow of FIG. 1.

Referring now to FIG. 2, the exemplary pillow 10 includes a cushion material 30. As previously mentioned, the exemplary pillow 10 has a generally rectangular peripheral shape with actuate upper and lower surfaces 14, 16. To this end, as shown in FIG. 2, the exemplary cushion material 30 has a rectangular perimeter shape with a curved lower surface 34 and a curved upper surface 35. The upper surface 35 of the cushion material 30 also defines a recess 36, which receives a coil panel 40 and a gel layer 50, which collectively form a gel molded spring array 52 as will be described further below. Of course, the cushioning material of the present invention may be any number of various shapes, depending on the use of the body support cushion. For example, in other embodiments, the upper and lower surfaces of the cushion material can be planar, and/or may comprise surfaces having ribs, bumps, and other protrusions of any shape and size, surfaces having grooves, dimples, and other apertures that extend partially through, nearly completely or entirely through the cushion material.

With respect to the cushion material 30, in the exemplary pillow 10, the cushion material 30 is made of a viscoelastic foam (sometimes referred to as "memory foam" or "low resilience foam"). However, in other embodiments, the cushion material may be formed of various materials without departing from the spirit and scope of the present invention including, but not limited to, a latex foam or a reticulated non-viscoelastic foam may be used.

The cushion material may be formed of various foams throughout the various embodiments and the following summary is non-exhaustive. For example, open-celled or non-reticulated viscoelastic foam may be used. In some embodiments, foams which are temperature responsive may be used. A temperature responsiveness in a range of a user's body temperatures (or in a range of temperatures to which the pillow 10 is exposed by contact or proximity to a user's body resting thereon) can provide significant advantages. As used herein and in the appended claims, a material is considered "responsive" to temperature changes if the material exhibits a change in hardness of at least 10% measured by International Organization for Standardization (ISO) Standard 3386 through the range of temperatures between 10 and 30 degrees Celsius. In other embodiments, it may be desirable that the foam be substantially insensitive to temperature. As used herein, a material is "substantially insensitive" to temperature changes if the material exhibits a change in hardness of less than 10% measured by ISO Standard 3386 through the range of temperatures between 10 and 30 degrees Celsius. In some embodiments, a flexible polyurethane foam may be used and, in some embodiments, a reticulated foam may be utilized.

The cushion material of the pillow 10 may be comprised of any of the various mentioned flexible foams which are capable of distributing pressure from a user's body or portion thereof across the pillow 10 or, more generally, the body support cushion 10. In some illustrative embodiments, the density of the flexible foam used typically has a density sufficient for supporting the neck and shoulders of a user. Such flexible foams may include, but are not limited to, latex foam, reticulated or non-reticulated viscoelastic foam (sometimes referred to as memory foam or low-resilience foam), reticulated or non-reticulated non-viscoelastic foam (sometimes referred to as "conventional" foam), polyurethane high-resilience foam, expanded polymer foams (e.g., expanded ethylene vinyl acetate, polypropylene, polystyrene, or polyethylene), and the like, or any combination thereof.

The exemplary cushion material 30 is a viscoelastic foam that has a low resilience as well as a sufficient, density and hardness, which allows pressure to be absorbed uniformly and distributed evenly across the cushion material 30 of the pillow 10. Generally, such viscoelastic foams have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression, is held for a set period of time as established by the International Organization of Standardization (ISO) 2439 hardness measuring standard. In some examples, the body support cushion or pillow 10 may utilize foam that is comprised of viscoelastic foam with a density of about 70 $kg/m^3$ to about 110 $kg/m^3$ and a hardness of about 25 N to about 50 N. In some embodiments, the viscoelastic foam may have a hardness of about 10 N, about 20 N, about 30 N, about 40 N, about 50 N, about 60 N, about 70 N, or about 80 N to provide a desired degree of comfort and body-conforming qualities.

The viscoelastic foam used for the exemplary cushion material 30 of the pillow 10 may also have a density that assists in providing a desired degree of comfort and body-conforming qualities, as well as an increased degree of material durability. In some embodiments, the density of the viscoelastic foam used may have a density of no less than about 30 $kg/m^3$ to no greater than about 150 $kg/m^3$. in some embodiments, the density of the viscoelastic foam used in the pillow 10 may be about 30 $kg/m^3$, about 40 $kg/m^3$, about 50 $kg/m^3$, about 60 $kg/m^3$, about 70 $kg/m^3$ about 80 $kg/m^3$, about 90 $kg/m^3$ about 100 $kg/m^3$, about 110 $kg/m^3$ about 120 $kg/m^3$, about 130 $kg/m^3$ about 140 $kg/m^3$, or about 150 $kg/m^3$. Of course, the selection of a viscoelastic foam having a particular density will affect other characteristics of the foam, including its hardness, the manner in which the foam responds to pressure, and the overall feel of the foam, but it is appreciated that a viscoelastic foam having a desired density and hardness can readily be selected for a particular application as desired.

The exemplary recess 36 defined in the upper surface 35 of the cushion material 30 is generally rectangular, but it is contemplated that the recess 36 may be formed of various perimeter shapes and have various depths determined, for example, according to the shape and size of the coil panel 40 and the gel layer 50 (i.e., the gel molded spring array 52). The recess 36 may be formed in various manners depending on the formation method of the body support cushion 10. For example, in the exemplary implementation discussed below with reference to FIG. 5, in which the cushion material 30 is made of a foam, a liquid gel and the coil panel are placed in a mold (e.g., in the form of a separately molded sheet including the coils and gels) and a foam precursor is applied so that the foaming occurs around the coil panel 40 and gel. Accordingly, in such an embodiment, once the liquid gel sets into the gel layer 50 and the foam precursor set, the resulting cushion material 30 is displaced about the coil panel 40 and gel layer 50 during the foaming process, to define the recess 36. Alternatively, in some embodiments, the coil/gel sheet can be formed together in a separate mold and, once cured, can be placed in another mold in which the liquid precursor of the cushion materials is around to form an exemplary pillow. In further embodiments and as another alternative, if the cushion material is formed independently, the recess may also be formed therein or cut after the cushion material is formed.

Figure 3:
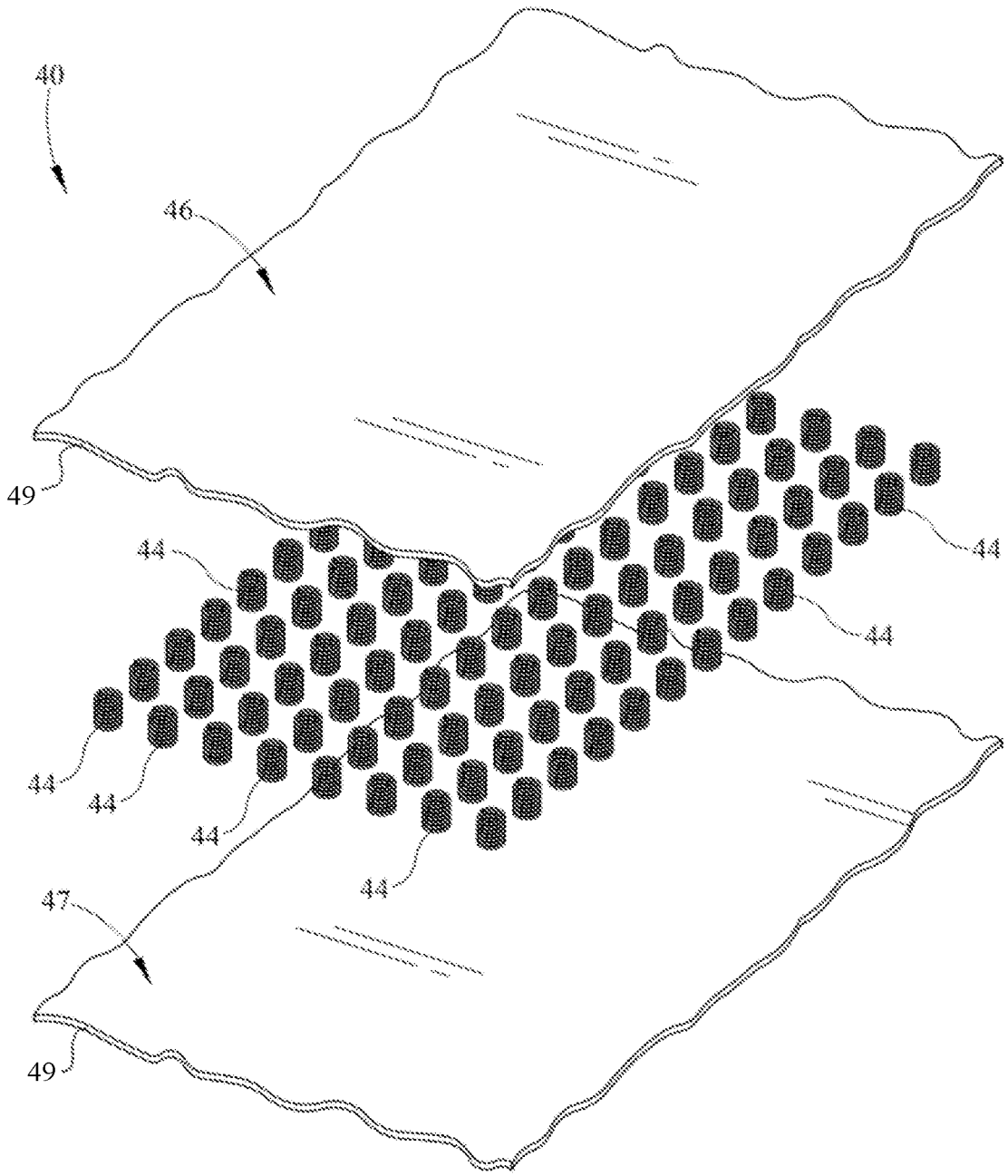
FIG. 3 is a exploded perspective view of the coil panel shown in FIG. 2.
Figure 3A:
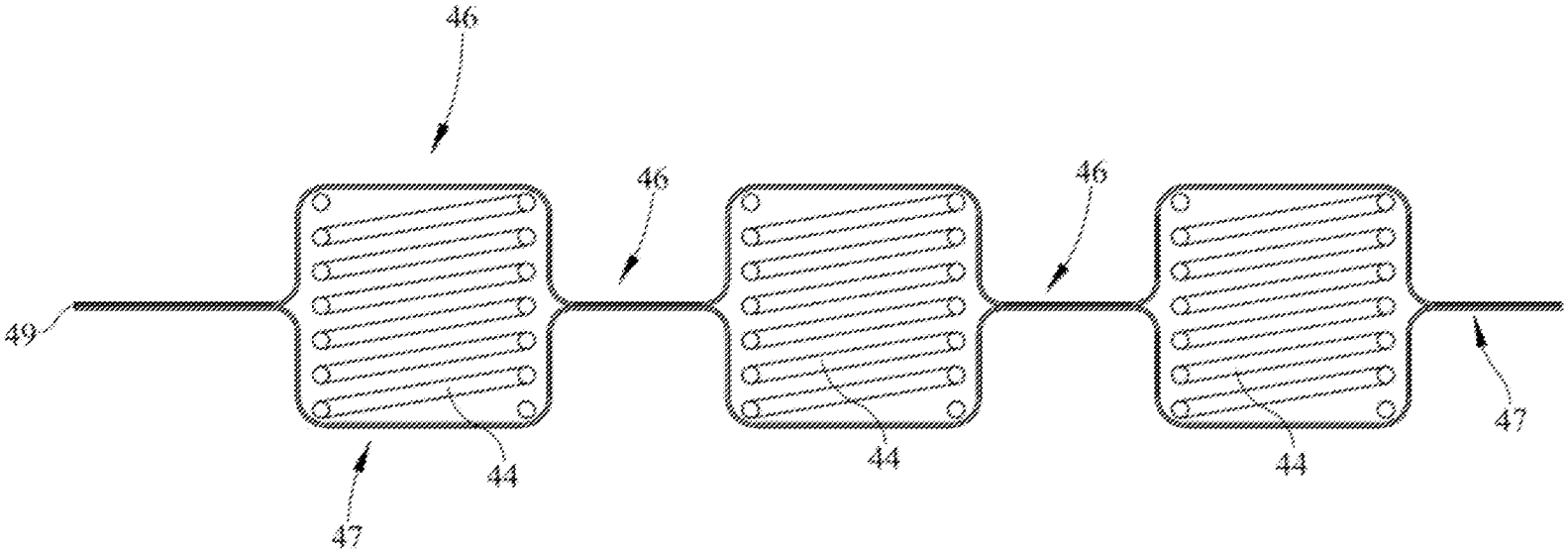
FIG. 3A is a section detail of the coil panel shown in FIG. 2.

Turning now to the coil panel 40 which is disposed within the recess 36 of the cushion material 30 and forms part of the gel molded spring array 52, and referring now to FIGS. 3-3A, the exemplary coil panel 40 is formed of a plurality of coil springs 44 which are laid out in an array or matrix of rows and/or columns. An upper first fabric layer 46 is arranged over an upper end of each coil spring 44 and a lower second fabric layer 47 arranged under the lower end of each coil spring 44. The first and second fabric layers 46, 47 are joined, e.g. welded, between the coil springs 44, thereby forming a coil pocket. The ends of the coil springs 44 may be in direct contact with the fabric layers 46, 47, or alternatively, a piece of material, such as cushion or scrim may be disposed between the coil springs 44 and the fabric layers 46, 47. Such intermediate material may inhibit the coil springs 44 from poking through or otherwise tearing the fabrics layers 46, 47. The first and second fabric layers 46, 47 are additionally joined, e.g. welded, along the peripheral edges 49 of the first and second fabric layers 46, 47 to define the coil panel 40. Furthermore, the two fabric layers 46, 47 may be two distinct fabrics pieces or, in some embodiments, may be a single fabric piece folded over the springs and joined at open ends. The space illustrated in FIG. 3A between the coil springs 44 is illustrative of the weld between the first and second fabric layers 46, 47, and is not intended to be limiting. For example, in some embodiments, a weld joining the first and second fabric layers 46, 47 may have a width of about 3 mm to about 5 mm. Likewise, the size of the coil pocket formed by the first and second fabric layers 46, 47 may vary based on the size of the coil spring contained therein.

The first and second fabric layers 46, 47 may be made of various materials. Non-limiting examples of materials include non-wovens, warp knits, nylon, rayon, polyester, spacer fabric, or the like. This list however is non-exhaustive. As an example, where a non-woven fabric is used, it may be desirable for the non-woven fabric to be free of various defects including, but not limited to, shavings, scabs, holes, and/or scraps. Additionally, in some such instances, where a non-woven may be used, the non-woven fabric may have a weight between about 40 $g/m^2$ and about 80 $g/m^2$. In other instances, the first and second fabric layers 46, 47 may be made of different materials. For example, the first fabric layer 46 may be a spun lace mesh fabric (for example, with a weight of about 70 $g/m^2$), while the second fabric layer 47 may be a non-woven as described previously.

As previously mentioned and shown in FIG. 2, a gel layer 50 is disposed adjacent to the coil panel 40. As such, in some embodiments, it may be desirable for the fabric of at least the first fabric layer 46 to be capable of minimizing, or entirely preventing the gel layer 50 from infiltrating, creeping, or otherwise coming into contact with the coil springs 44. More specifically, such a fabric may minimize or prevent the gel from infiltrating, creeping, or otherwise contacting in between the convolutions of the springs, which may bind the springs and/or reduce their functionality. To this end, the first and second fabric layers 46, 47 are, in some embodiments, a hydrophobic fabric, water-resistant fabric, or the like.

In some embodiments, the material of the first and second fabric layers may limit air permeability so that when the coil panel 40 is compressed the air cannot readily escape. Likewise, when the compression force on the pillow is released, the expansion of the coil panel 40 may occur slowly due to the slow pull of air through the first and second fabric layers 46, 47. In some other embodiments, the material of the first and second fabric layers may be air impermeable with air permeable portions located at specific locations. By controlling the size, numbers and/or locations of the air permeable locations, the air flow into and out of the fabrics layers 46, 47 and coil panel 40 may also be controlled.

Figure 7:
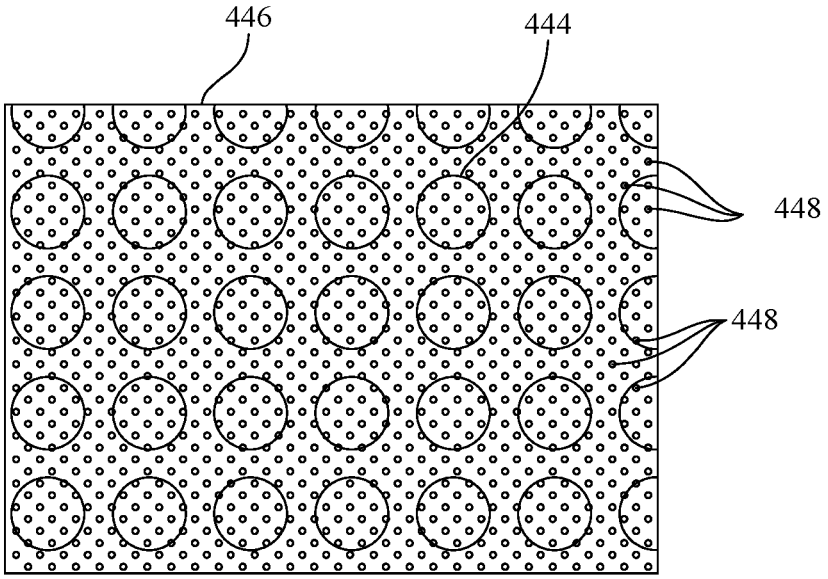
FIG. 7 is a top view of one exemplary fabric layer for use in a coil panel that defines a plurality of apertures in a first pattern.
Figure 8:
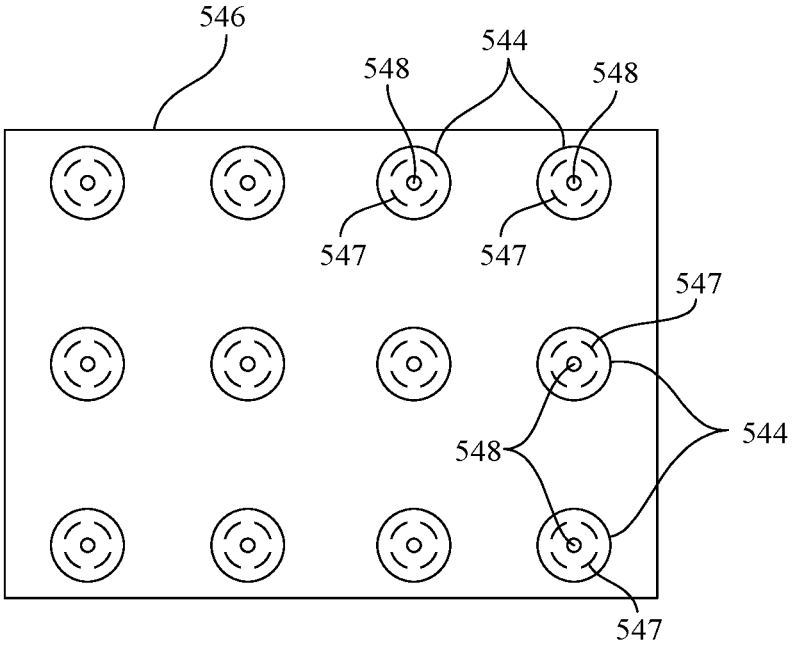
FIG. 8 is a top view of another exemplary fabric layer for use in a coil panel that defines a plurality of apertures within a central welded portion.

For example, and referring now to FIGS. 7-8, according to some exemplary embodiments, the coil panel may define a plurality of airflow apertures to vary the amount of airflow through the coils and the panel. More specifically, in some embodiments, the first and/or second fabric layers may have varying densities of apertures to improve the airflow through each panel. In FIG. 7, an exemplary first fabric layer 446 arranged over a plurality of coil springs 444 defines a number of apertures 448 per square inch. Modifying the aperture size and density in the first and/or second fabric layers would, of course, adjust air flow through the coil panel.

FIG. 8 illustrates another exemplary first fabric layer 546 with an alternative pattern of apertures. In this illustrated embodiment, in addition to welding the first fabric layer 546 to a second fabric layer (not shown) between the coil springs 544, the first fabric layer 546 is additionally welded to the second fabric layer in a center portion of the coil springs 544 to form a central welded portion 547 within each of the coil springs 544. As shown in FIG. 8, an aperture 548 is then defined within these central welded portions 547 to allow for airflow. As a non-limited example, the central welded portion 547 has a diameter of about 21 mm to about 25 mm and the aperture 548 has a diameter of about 9 mm to about 10 mm. Although the above descriptions of FIGS. 7-8 are directed towards a first fabric layer, it should be understood that the second fabric layer can likewise include apertures instead of, or in addition to, the first fabric layer within one or more of the first and second coil panels of the present invention.

Returning again to FIGS. 3 and 3A, but focusing now on the plurality of coil springs 44 of the coil panel 40, the number of coils per square foot for the exemplary coil panel 40 may be in the range of about 14 to about 250. The coil springs 44 may be of various sizes and number within the coil panel 40. In some non-limiting embodiments, for example, the coil springs may be up to about 3 inches in diameter and up to about 3 inches tall in a compressed height. The springs may have an un-loaded height, and may also have a loaded height, which is shorter than the un-loaded, fully relaxed height. As a non-limiting example, coil mini springs may be used which have an un-loaded or coil free height of about 20 mm to about 26 mm, and a loaded or compressed height of about 18 mm to about 20 mm. Alternatively, as a second non-limiting example, larger coils may be used which have an un-loaded or coil free height of about 90 mm to about 110 mm, and a loaded or compressed height of about 27.5 mm to about 32.5 mm. The coil springs may be, in some instances, constructed of a 17.5 gauge wire (e.g. a wire with a diameter of about 1.25 mm) or a 19.5 gauge wire. The coil springs may have consistent wire size (diameter) or the wire size may vary across the coil spring. The coil springs may, in some instances, be turned approximately three and three-quarter (plus or minus a quarter turns) times to construct the coil. When constructed, each end of the wire forming the coil may be inside the coil spring structure. Coil springs may be various shapes, for example may be barrel, cylindrical or hourglass in shape. Pitches and diameters may be symmetrical or non-symmetrical which allows the coil springs to have either a linear or non-linear response when compressed. However, other sizes, shapes, and variations may be utilized. For example, the coil spring may be a coil-in-coil design, wherein one or both coils may vary in diameter—for example a conical design. Still further combinations of coil types may be utilized.

The coil springs 44 may be loaded by way of engagement and joining of the first and second fabric layers 46, 47. Specifically, the coil springs 44 may be preloaded to about 0.1 pound-force to about 0.8 pound-force. The coil springs 44 may also vary in spring constant. That is, the coil springs 44 may have a spring constant of about 0.2 lbs/in to about 3.0 lbs/in. Also, the spring constant may be the same or the same range across the surface of the pillow 10, or alternatively may vary in range, or vary by location.

The coil springs 44 may also vary in spring constant. That is, the coil springs 44 may have a spring constant of about 0.2 lbs/in to about 3.0 lbs/in. Also, the spring constant may be the same or the same range across the coil panel 40, or alternatively may vary in range, or vary by location.

As previously discussed, the coil springs 44 may have an un-loaded height, and may also have a loaded height, which is shorter than the un-loaded, fully relaxed height. The springs 44 may be loaded by way of engagement and joining of the two fabrics 46, 47. This initial loading of the springs may provide the initial support and/or push back force for the springs 44.

Figure 3B:
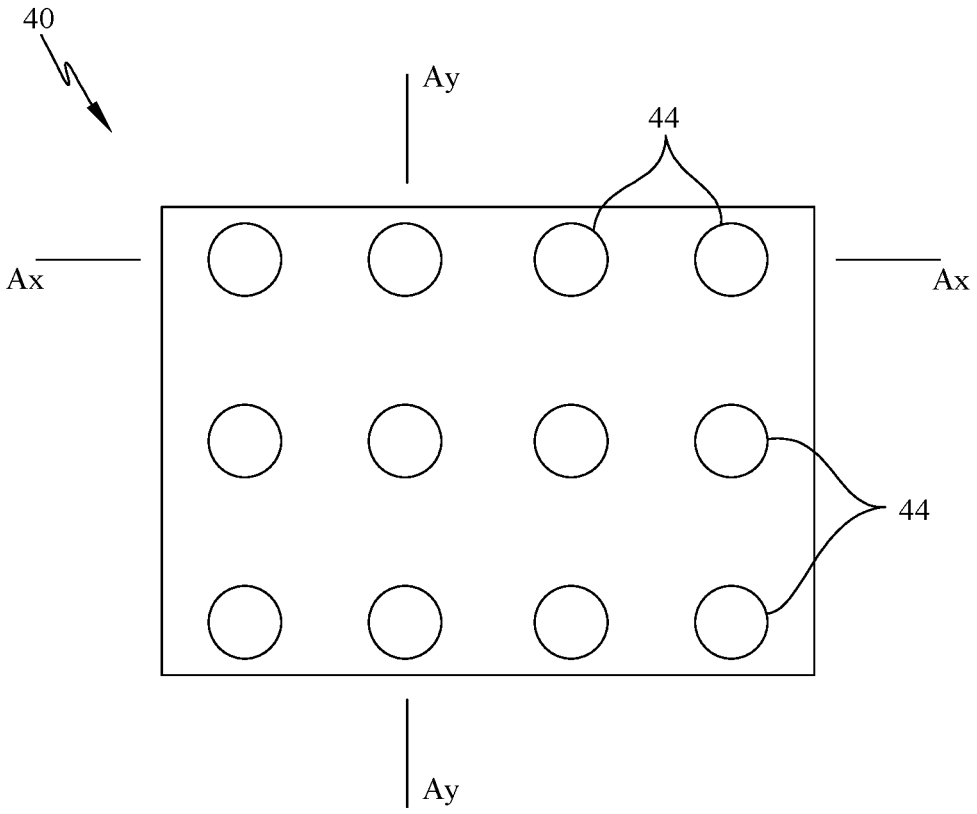
FIG. 3B is a schematic layer view of the coil pattern of the coil panel shown in FIG. 2.
Figure 6:
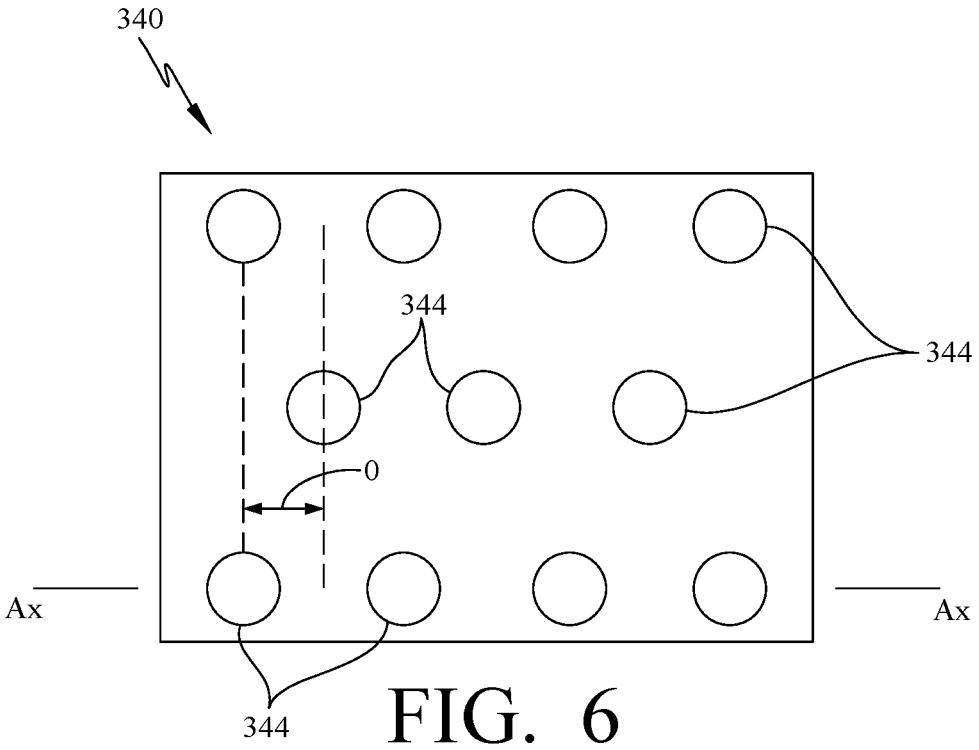
FIG. 6 is a schematic layer view of another exemplary coil pattern for use in a coil panel.

With reference now to FIG. 3B, in the exemplary coil panel 40, the coil springs 44 are arranged in rows in the direction Ax and columns in the direction Ay. However, and with reference now to FIG. 6, in another exemplary coil panel 340, while the plurality of coil springs 344 are still arranged in rows in the direction Ax, the coil springs 344 are not aligned in columns in the direction Ay as in the previous embodiment of FIG. 3B. Instead, every other row is offset a distance O. Other patterns of coil springs are also contemplated depending on the design characteristics and considerations of the body support cushion.

While the exemplary pillow 10 shown in FIG. 2 only includes a single coil panel 40 as part of the gel molded spring array 52, it should be understood that the gel molded spring array 52 may comprise two or more coil panels. Likewise, there may be multiple gel molded spring arrays located across the upper surface of the cushion material. The number and position of gel molded spring arrays and/or coil panels may be dependent upon the size of the body support cushion or other design characteristics and considerations.

Returning now once again to FIG. 2, as previously mentioned, disposed above the coil panel 40 is a gel layer 50. More specifically, the exemplary gel layer 50 extends outwardly beyond the outermost coils 44 of the coil panel 40, but the first and second fabrics 46, 47 of the coil panel 40 extend outwardly beyond the gel layer 50 when the coil panel 40 and gel layer 50 are adjacent each other. However, in other embodiments, the gel layer 50 may extend outwardly beyond the first and second fabrics 46, 47 when the coil panel 40 and gel layer 50 are adjacent to each other. Further, although only one gel layer 50 is shown, it is contemplated that in other embodiments a second gel layer may also be disposed on the lower surface of the cushion material.

The gel layer 50 included in the pillow 10 may be generally comprised of a substantially uniform layer of elastomeric gelatinous material that is capable of providing a cooling effect by acting as a thermal dump or heat sink into which heat from a user's body, or portion thereof positioned on the pillow 10 can dissipate. For example, in some embodiments, the gel layer 50 may be comprised of a polyurethane-based gel made by combining Hyperlast® LU 1046 Polyol, Hyperlast® LP 5613 isocyanate, and a thermoplastic polyurethane film or talc powder, which are each manufactured and sold by Dow Chemical Company Corp. (Midland, Mich.), and which can be combined to produce gel inserts having a thermal conductivity of 0.1776 W/m*K, a thermal diffusivity of 0.1184 $mm^2/s$, and a volumetric specific heat of 1.503 MJ/(m3K) as established by the International Organization of Standardization (ISO) 22007-2 volumetric specific heat measuring standard. It is also contemplated, however, that numerous other types of gels capable of absorbing an amount of heat and providing a cooling effect can be used in accordance with the present embodiments, and can be produced to have desired thermal conductivity, thermal diffusivity, and volumetric specific heat without departing from the spirit and scope of the subject matter described herein.

In some embodiments, the gel layer 50 may have an outer surface which is substantially smooth, but the surface shape and texture of the gel may be determined by the corresponding surface of the mold in which the gel is poured. Further, the gel may also vary in concentration along the surface of the pillow. The peripheral edge or perimeter of the gel may be regular in shape or may be irregular as will be understood following discussion of the exemplary methods of forming the body support cushions of the present invention. Further, the gel may also vary in thickness and/or concentration. For example, the thickness of the gel may be greater in the center as compared to areas toward the periphery of the gel.

In the exemplary pillow 10, the outer surface of the gel layer 50 is substantially flush with the upper surface 35 of the cushion material 30 so that the outer surface of the gel layer 50 and the upper surface 35 of the cushion material 30 collectively form the upper surface 14 of the body support cushion 10. The outer surface of the gel layer 50 may form a shape which is generally symmetrical with the opposite side of the pillow 10 (i.e., the lower surface 16), even though the materials defining the sides differ. However, as previously described, other shapes may be utilized.

According to some other embodiments, however, the gel layer may be surrounded by the cushion material in such a manner that the materials are not flush. For example, the gel layer may be inset, or recessed, within the surrounding cushion material or the gel layer may extend outwardly beyond the upper surface of the cushion material in part or in whole. For example, the outer surface of the gel may define one or more features that extend beyond an otherwise generally planar upper surface of the pillow, such as ribs or bumps. Likewise, instead of merely being positioned within the recess adjacent to the coil panel, additional gel may also be disposed within divots of the foam.

With further respect to the density and hardness of the pillow 10, as indicated above, the density of the gel layer 50 is typically different than the density of the cushion material 30. In the exemplary pillow 10 shown in FIG. 2, the density of the cushion material 30, e.g., viscoelastic foam, is sufficient for supporting the neck and shoulders of a user, but the gel layer 50, has a greater density that is suitable for supporting to the head of the user. More specifically, the exemplary cushion material is comprised of viscoelastic foam with a density of about 40 $kg/m^3$ to about 80 $kg/m^3$ and a hardness of about 25 N to about 50 N, while the exemplary gel layer 50 is comprised of very soft, polyurethane gel with a density of about 800 $kg/m^3$ to about 1200 $kg/m^3$ and a hardness of about 25-50 shore OOO. Of course, the particular density and other support characteristics of both the cushion material and the gel can vary depending design characteristics for the support cushion.

In some embodiments, one or more of the cushion material 30, the coil panel 40, and the gel layer 50 may be covered individually or collectively with a netting material (now shown). The netting material may be any textile in which the yarns or fibers are fused, looped or knotted at their intersections, resulting in a fabric with open spaces between the yarns or fibers. Depending on the type of yarn or filament that is used to make up the textile, its characteristics can vary in durability. The netting material may be formed of single knit jersey, double knit jersey, double rib knit, may be made of fire resistant or non-fire resistant textiles and may have a porosity of from about 50 to about 850 CFM. The fire resistant textiles may include, for non-limiting example, fire resistant rayon, modified acrylics, Kevlar, nomax and others. Non-fire-resistant textiles may include, for non-limiting example, untreated polyester, rayon, or cotton.

Referring still to FIG. 2, a cover 60 is also disposed about the cushion material 30 and the gel molded spring array 52. In the exemplary pillow 10, the cover 60 is made of a fabric, but in other embodiments various materials may be used including, but not limited to, cotton, cotton blends, moisture-wicking fabric, such as 100% polyester fabric, rayon, nylon, or spandex-blend fabric for increased performance and stretch-ability or blends of any of the preceding. This list is non-exhaustive and other materials may be used. The cover 20 fabric may be quilted and/or may include various designs, including but not limited to labels for a "firm" or "soft" side. The cover 60 also defines the outer periphery of the pillow 10 and therefore the shapes of the various layers located within the cover 20, together with the peripheral edge of the cover 20 define the shape of the pillow 10. The cover 60 may also include phase change material in some embodiments in order to enhance cooling feel to the user. If desirable, it is contemplated that a pillow case, typically formed of a thin fabric may be placed over the cover 20. The exemplary cover 20 is closed about the peripheral edge 18 and includes a closure 62 to access the interior of the pillow 10 or alternatively, remove the internal contents for washing of the cover 60 when desired. The closure 62 may extend along one or more sides of the pillow 10 to ease placement of the layers therein. The closure 62 may be of various types including but not limited to zippers, button, snaps, hook and loop fasteners, and the like.

Figure 4:
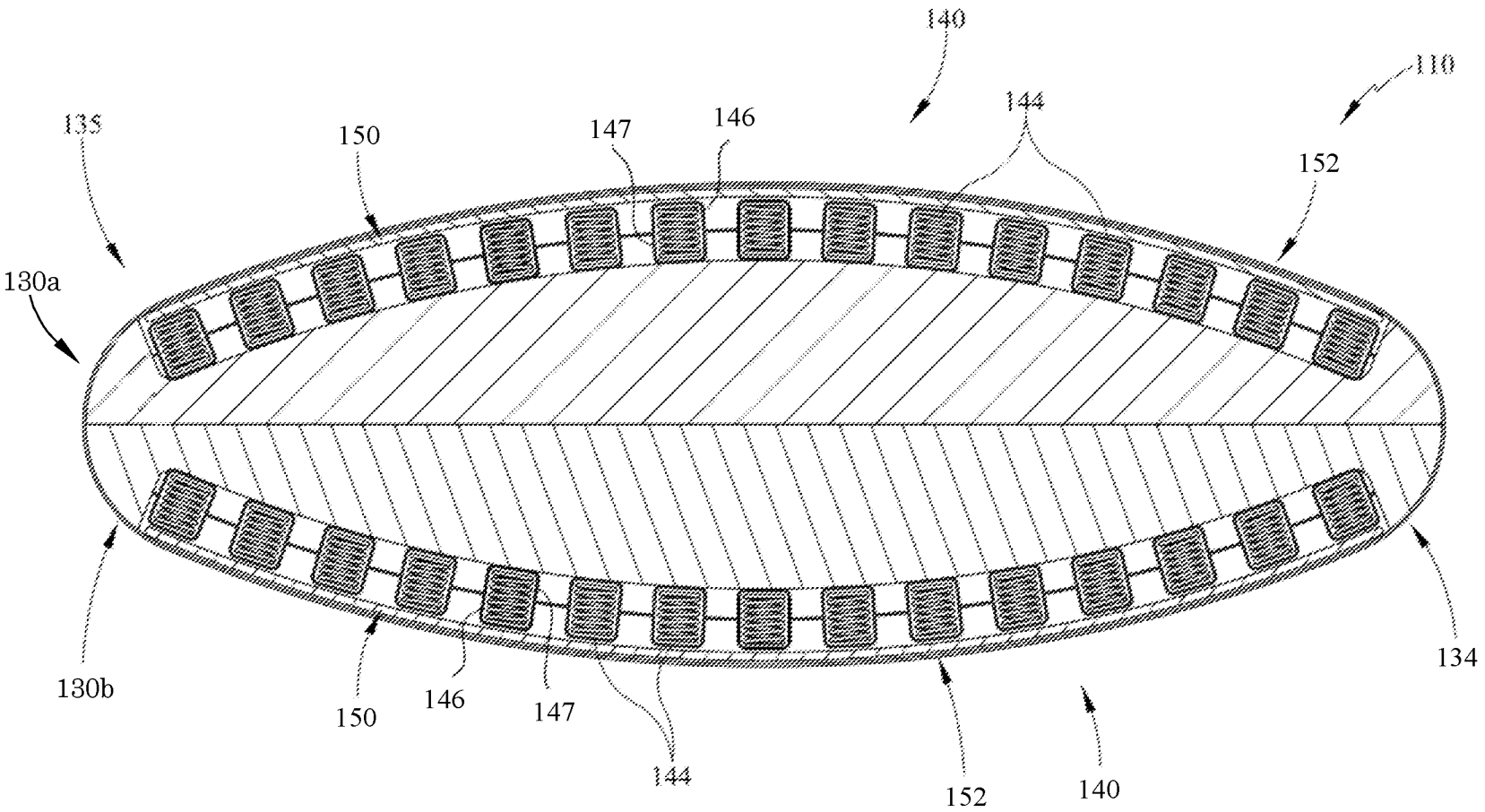
FIG. 4 is an exploded perspective view of another exemplary hybrid pillow made in accordance with the present invention.

Referring now to FIG. 4, a second exemplary body support cushion 110 made in accordance with the present invention, similarly includes a gel molded spring array 152 on the upper surface 135 of the cushion material 130*a*, 130*b*, but also includes a second gel molded spring array 152 on the lower surface 134 of the cushion material 130*a*, 130*b*.

Each of the gel molded spring array 152 includes a coil panel 140 and a gel layer 150 substantially the same as gel molded spring array 52 described above with reference to FIG. 2. Specifically, each coil panel 140 include a plurality of coils or springs 144 enveloped in a first and second fabric layer 146, 147, substantially the same as the coil panel 40 described above with reference to FIGS. 2 and 3. In the embodiment shown in FIG. 4, the coil panel 140 at the upper surface 135 of the cushion material 130 and the coil panel 140 at the lower surface 134 of the cushion material 130 may have the same characteristics or may have differing characteristics to provide different feel on the two sides of the body support cushion 110.

Each of the gel layers 150 included in the pillow 110, is comprised of a substantially uniform layer of elastomeric gelatinous material that is capable of providing a cooling effect by acting as a thermal dump or heat sink into which heat from a user's body, or portion thereof positioned on the pillow 110 can dissipate.

The coil panels 140 and gel layers 150 are also similarly disposed in the cushion material 130*a*, 130*b* in substantially the same manner as described above with reference to FIG. 2. As shown in FIG. 4, the cushion material 130*a*, 130*b* is formed of an upper foam piece 130*a* and a lower foam piece 130*b* which are brought together to form the cushion material 130*a*, 130*b*. According to other embodiments, however, a similar two-sided pillow can be formed with a single cushion material.

Figure 5:
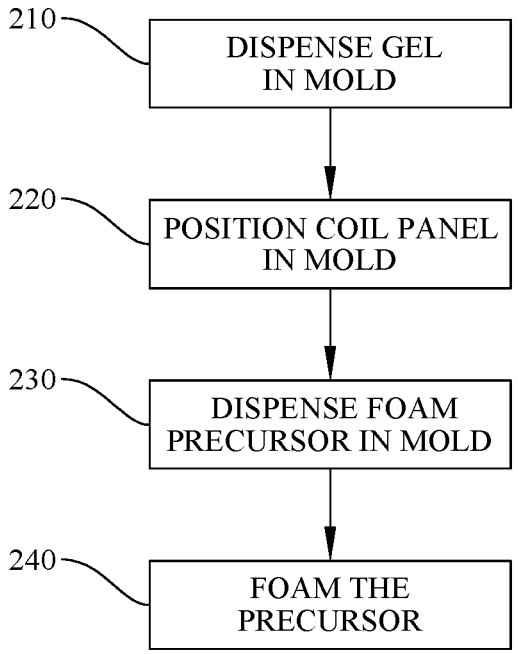
FIG. 5 is a flow chart depicting an example method of forming a molded hybrid pillow.

Referring now to FIG. 5, an exemplary method of manufacturing a hybrid pillow made in accordance with the present invention begins with a mold which may vary in shape and size, but may, in some embodiments, have generally the perimeter shape similar to the body support cushion 10 shown in FIG. 2. For example, the mold may be rectangular with curved upper and lower halves which define the crowned shape of the exemplary pillows 10, 110 shown in FIGS. 1 and 4. However, any of the shapes and designs of support cushions described above are capable of being formed in a single mold, or tool. The mold may be formed of first and second halves, as discussed below.

According to the exemplary implementation, in a first step 210, a liquid gel is dispensed in the mold. The amount of gel may vary depending on the size and/or depth of the mold as well as the particular design of the final molded hybrid pillow. As discussed further below, according to some other exemplary implementations, a solid gel can also be provided in the mold rather than a liquid gel.

After the liquid gel is dispensed in the mold, in a step 220, a coil panel is positioned in the mold on top of the gel. The resulting construction results in a gel layer which is molded on one side of the coil panel to form a gel molded spring array, similar to the gel molded spring arrays 52, 152 described above. While the liquid gel and coil panel may be applied within the mold individually, in other embodiments, a gel layer and coil panel may be applied to the mold as a combined structure. That is to say, according to some exemplary implementations of the present invention, the gel layer may be molded separately then be positioned in the mold before or after it is applied to the coil panel. In such an instance, the gel layer may be formed on a backing that is then removed for placement.

According to some embodiments, there are two or more coil panels included in the exemplary pillow, for example as described above with reference to the exemplary pillow 110 shown in FIG. 4. Accordingly, in such embodiment, the method may comprise the additional step of placing an additional coil panel and/or gel layer in the mold. For example, in a mold with two sides that are folded closed, a gel (liquid or solid) and coil panel may be provided on each of the two sides before the mold is closed. Likewise, additional gel layers and coil panels may be provided in a second portion of the mold to provide a support cushion in which there are multiple gel molded spring arrays.

After positioning the coil panel and gel layer to the mold, in a step 230, a liquid foam precursor is dispensed in the mold. Afterward, the mold may be closed and the liquid precursor is foamed in a step 240 to form the cushion material. In other words, the molded form is disposed on the gel molded spring array opposite from the gel layer. According to the exemplary embodiment, this foaming step 240 connects the coil panel and gel layer to the resulting cushion material. Specifically, it is contemplated that during the foaming step 240, the gel layer and molded foam are secured to one another about a perimeter of the coil panel. In this way, the molded foam of the cushion material at least partially encloses the gel molded spring array with the coil panel fully encapsulated between the gel layer and the molded foam of the cushion material. It is contemplated that in embodiments where a liquid gel is provided in the mold, the gel may solidify before or during the time when the liquid precursor is foamed. Regardless, once the foaming step is complete, the mold may be opened and the body support cushion removed.

According to implementations in which the gel is initially provided as a liquid, the concentration of the resulting gel layer may vary across the resulting support cushion. As the gel liquid is poured into the mold and settles toward a bottom of the mold the liquid gel may, in some embodiments, have a thicker depth at its center and a thinner depth near the peripheral edges. An exemplary pillow manufactured with a liquid gel may therefore have less of the final gel layer towards the edges of the pillow and more of the final gel layer within the crown area of the pillow. Likewise, due to the settling of the liquid gel the resulting gel layer may, in some embodiments, have an irregular shape.

According to other implementations, rather than forming the gel layer in the same mold as the cushion material such that the concentration of the gel layer varies across the pillow, the gel layer may be applied to the cushion material after the gel layer has been formed separately. The coil panel may still be provided in the mold prior to proving the foam precursor so that the coil panel is integrated into the cushion material. Alternatively, both the coil panel and the gel layer may be applied to the cushion material after it has been formed.

Each of the above described exemplary pillows may additionally include additives such as copper to improve the characteristics relative to moisture content and inhibition of mold growth. Other additives may be provided to improve fire retardants or improve the smell of the foam, such as carbon or charcoal additives for filtration. Other additives, for example, graphite, aluminum, silver, charcoal, gel, and others can also be included for a variety of benefits known in the art. Further additions to the exemplary pillows can provide far infrared radiation for rejuvenating properties. Still further, on or more layers of the pillow may be coated with nanobionic materials or phase change materials (PCM) to enhance a cooling feel to the user. These phase change materials (PCM) may be coatings, including but not limited to, commercially available organic, inorganic, solid and biological materials. Additionally, one or more layers may further include biocides, preservatives, odor blocking agents, scents, pigments, dyes, stain guards, antistatic agents, anti-soiling agents, water-proofing agents, moisture wicking agents, and the like, as are known in the art.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A hybrid pillow, comprising:

a cushion material defining a first recess and a second recess opposite the first recess;

a first coil panel positioned within the first recess of the cushion material, the first coil panel formed of a first plurality of coil springs, a first upper fabric layer, and a first lower fabric layer, the first upper fabric layer and the first lower fabric layer joined between the first plurality of coil springs and along peripheral edges of the first coil panel;

a first gel layer positioned within the recess of the cushion material and over the first coil panel;

a second coil panel positioned within the second recess of the cushion material opposite from the first coil panel, the second coil panel formed of a second plurality of coil springs, a second upper fabric layer, and a second lower fabric layer, the second upper fabric layer and the second lower fabric layer joined between the second plurality of coil springs and along peripheral edges of the second coil panel; and a second gel layer positioned within the second recess of the cushion material and over the second coil panel.

2. The hybrid pillow of claim 1, wherein the first gel layer is molded on one side of the first coil panel to form a gel molded spring array.

3. The hybrid pillow of claim 2, wherein the cushion material includes a molded foam disposed on the gel molded spring array opposite from the first gel layer, and wherein the molded foam and the first gel layer are secured to one another about a perimeter of the first coil panel.

4. The hybrid pillow of claim 3, wherein the molded foam of the cushion material at least partially encloses the gel molded spring array.

5. The hybrid pillow of claim 3, wherein the first coil panel is fully encapsulated between the first gel layer and the molded foam of the cushion material.

6. The hybrid pillow of claim 3, wherein the gel molded spring array defines a first surface of the hybrid pillow.

7. The hybrid pillow of claim 1, wherein a first side of the hybrid pillow has a first feel and a second side of the hybrid pillow has a second feel that differs from the first feel.

8. The hybrid pillow of claim 1, wherein the first gel layer extends from the first recess of the cushion material.

9. The hybrid pillow of claim 1, wherein the first upper fabric layer and the first lower fabric layer are formed of a non-woven material or a hydrophobic material.

10. A method of manufacturing a hybrid pillow, the method comprising the steps of:

dispensing a liquid gel in a mold;

positioning a coil panel in the mold and on top of the liquid gel, the coil panel formed of a plurality of coil springs, an upper fabric layer, and a lower fabric layer, the upper fabric layer and the lower fabric layer joined between the plurality of coil springs and along peripheral edges of the first coil panel;

dispensing a foam precursor in the mold; and foaming the foam precursor to form a cushion material that is secured to the coil panel;

wherein the liquid gel solidifies as a gel layer positioned on the coil panel.

11. The method of claim 10, wherein the liquid gel solidifies prior to the step of foaming the foam precursor such that a gel molded spring array is formed prior to dispensing a foam precursor in the mold.

12. The method of claim 10, the cushion material and the gel layer are secured to one another about a perimeter of the coil panel.

13. The method of claim 10, wherein the coil panel is fully encapsulated between the gel layer and the cushion material.

14. The method of claim 10, wherein the liquid gel solidifies during the step of foaming the foam precursor.

15. A molded hybrid pillow, comprising:

a cushion material defining a first recess and a second recess opposite the first recess;

a first coil panel positioned within the first recess of the cushion material, the first coil panel formed of a first plurality of coil springs, a first upper fabric layer, and a first lower fabric layer, the first upper fabric layer and the first lower fabric layer joined between the first plurality of coil springs and along peripheral edges of the first coil panel;

a first gel layer positioned within the recess of the cushion material and over the first coil panel;

a second coil panel positioned within the second recess of the cushion material opposite from the first coil panel, the second coil panel formed of a second plurality of coil springs, a second upper fabric layer, and a second lower fabric layer, the second upper fabric layer and the second lower fabric layer joined between the second plurality of coil springs and along peripheral edges of the second coil panel; and a second gel layer positioned within the second recess of the cushion material and over the second coil panel, wherein at least one of the first upper fabric layer and the first lower fabric layer prevents contact between the first gel layer and convolutions of the first plurality of coil springs.

16. The molded hybrid pillow of claim 15, wherein the first upper fabric layer and the first lower fabric layer are formed of a non-woven material or a hydrophobic material.

17. The molded hybrid pillow of claim 15, wherein the first plurality of springs each have an encased height of less than three inches and a diameter of less than two inches.

18. The molded hybrid pillow of claim 15, wherein the first gel layer extends outwardly beyond an outermost row of the first plurality of springs.

19. The molded hybrid pillow of claim 15, wherein the first upper fabric layer and the first lower fabric layer extend outwardly beyond the first gel layer.

* * * * *